US007306107B2

(12) United States Patent
Secondino

(10) Patent No.: US 7,306,107 B2
(45) Date of Patent: Dec. 11, 2007

(54) ORGANIZER WALL

(76) Inventor: James Secondino, 91 Turning Leaf Drive, Woodbridge, Ontario (CA) L4H 2J4

( * ) Notice: Subject to any disclaimer, the term of this patent is extended or adjusted under 35 U.S.C. 154(b) by 480 days.

(21) Appl. No.: 10/926,301

(22) Filed: Aug. 26, 2004

(65) Prior Publication Data

US 2005/0055938 A1 Mar. 17, 2005

(30) Foreign Application Priority Data

Aug. 28, 2003 (CA) ..... 2438430

(51) Int. Cl.
*A47F 5/08* (2006.01)

(52) U.S. Cl. ..... 211/94.01; 211/57.1

(58) Field of Classification Search ..... 211/94.01, 211/57.1, 189, 59.1, 54.1, 86.01, 87.01; 52/36.4, 52/36.5, 36.6, 588.1, 592.1, 483.1
See application file for complete search history.

(56) References Cited

U.S. PATENT DOCUMENTS 4,607,753 A * 8/1986 Radek ..... 211/94.01
4,805,783 A 2/1989 Mayer
5,138,803 A 8/1992 Grossen
5,170,605 A * 12/1992 Huddle ..... 52/588.1
5,577,337 A 11/1996 Lin
5,647,184 A * 7/1997 Davis ..... 52/592.1
5,655,674 A 8/1997 Holztrager
5,819,490 A * 10/1998 Current ..... 52/588.1
6,134,846 A 10/2000 Lamb
6,325,223 B1 * 12/2001 Hannen ..... 211/87.01
6,421,961 B1 7/2002 Mallozzi
6,763,957 B1 * 7/2004 Mullerleile ..... 211/94.01
D507,355 S * 7/2005 Fischer ..... D25/122
7,198,159 B2 * 4/2007 Fischer ..... 211/94.01
2004/0111980 A1 * 6/2004 Kosch ..... 52/36.5

FOREIGN PATENT DOCUMENTS

CA 2313744 6/2003

* cited by examiner

*Primary Examiner*—Jennifer E. Novosad
(74) *Attorney, Agent, or Firm*—Shapiro Cohen

(57) ABSTRACT

A panel for use in a plurality for a slat wall comprises a panel body with inner and outer surfaces, and upper and lower edges. A vertical link at the rear of the upper edge has an inner surface coplanar with the body inner surface; a fastener receiving member connected across the vertical link has an upwardly extending tongue and downwardly extending leg, having vertically coplanar outer surfaces and defining a first groove to receive fasteners to secure the panels to the wall. A cover extending from the body outer surface has a free end with an inward projection, the cover and a rear protrusion of the body lower edge together defining a second groove. When installed, the second grooves receive tongues of adjacent panels; the covers extend over the first grooves of adjacent panels; and the inward projections engage with outer surfaces of legs of adjacent panels.

12 Claims, 6 Drawing Sheets

ORGANIZER WALL

BACKGROUND OF THE INVENTION

This invention relates to improvements in slat wall organizer panel construction and in particular to provision of tongues and grooves on each panel, and a channel to receive fasteners and a cover to conceal the fasteners.

FIELD OF THE INVENTION

It is an object of this invention to provide an organizer wall including adjacent panels, each panel being provided with a groove at one longitudinal edge and a tongue on the opposite edge. Each panel also has a groove for receiving fastening means on one side of the panel and a cover for the groove on an opposite side. The panel also has an undercut slot to receive hook type fasteners.

BACKGROUND OF THE INVENTION

U.S. Pat. No. 4,805,783 shows a slat wall advertising panel having a light weight peripheral frame rather than fasteners. U.S. Pat. No. 5,655,674 discloses spaced apart solid panels glued to a backboard. U.S. Pat. No. 5,738,803 discloses a solid panel having multiple grooves secured to a wall by fasteners in the grooves and inserts to conceal the fasteners. U.S. Pat. No. 6,421,961 has hooks and fastening means in the same channel but provides no cover to conceal the fastening means. Furthermore U.S. Pat. No. 6,421,961 requires two panels to create one slot. This design could create problems if panels are not perfectly mated. Screws that are driven into interlocked panels of U.S. Pat. 6,421,961 can cause panels to separate where they are joined at the slot. If this happens, misalignment occurs and the opening of the slot can exceed the normal operating width and the result is loss of strength and support from the slot as well as panels that are not level.

The present invention seeks to provide a panel having a high strength to low weight ratio. This reduction in weight reduces manufacturing costs resulting in savings for the end user. A lightweight panel is easier for one person to install. Placement of fasteners above the hook retaining slot rather than in the slot increases the load carrying capability of the panel. A further feature of this invention is that the panels snap and lock into each other which ensures correct alignment and leveling of panels. This reduces the overall time for installation of the panels. This locking snap feature of the panels allows the user to let go of the mated panels during the installation process. The panel of this invention also provides a slot that accepts accessories which is one piece and integrated with the panel. The heads of the fasteners are completely concealed by a cover provided on the panel above thereby making the installed panels much more aesthetically pleasing. In other systems, if a screw is driven into the wrong place, then removing the screw leaves a visible hole in the panel. The cover on the adjacent panel conceals any such holes.

SUMMARY OF THE INVENTION

The present invention provides a panel for an organizing system where a number of adjacent panels are secured to a wall each of the panels having a tongue on one side, a groove on an opposite side, a second groove for fastening means securing the panels to the wall and a cover on each said panel for cooperating with the second groove of the adjacent panel to cover the fastening means and a channel for receiving hooks having a restricted opening for retaining the hooks.

DETAILED DESCRIPTION OF THE INVENTION

Figure 1:
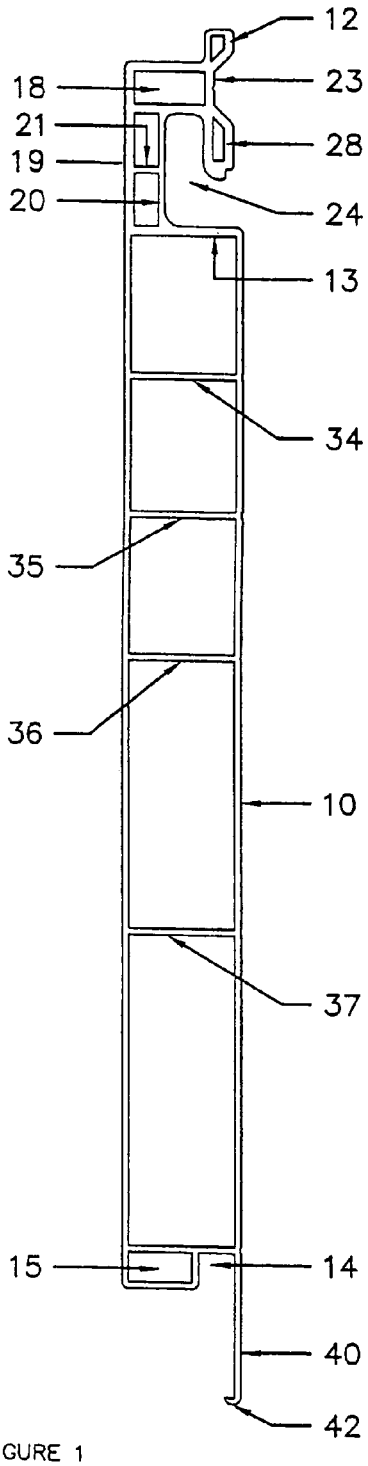
FIG. 1 is an end view of the display panel of this invention.
Figure 2:
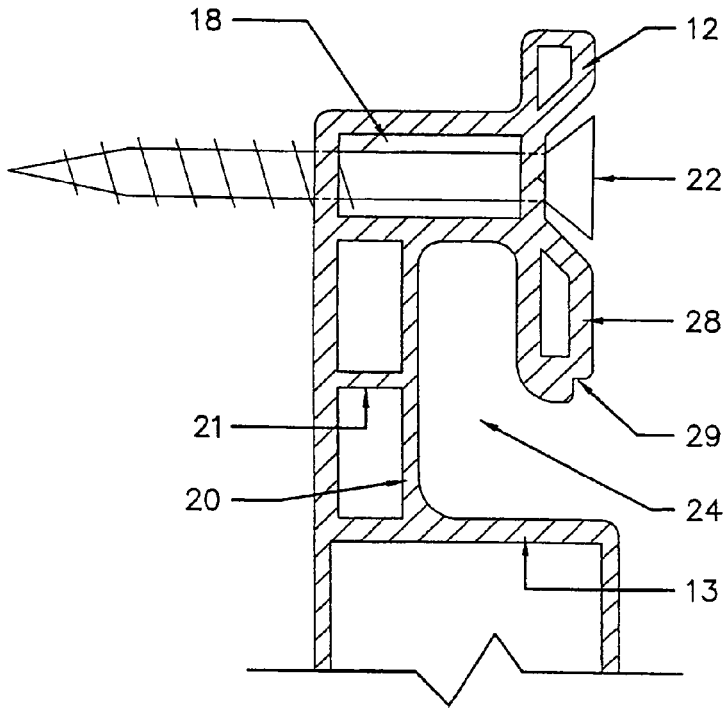
FIG. 2 is an enlarged fragmentary section of the panel of FIG. 1 showing placement of a fastener.
Figure 3:
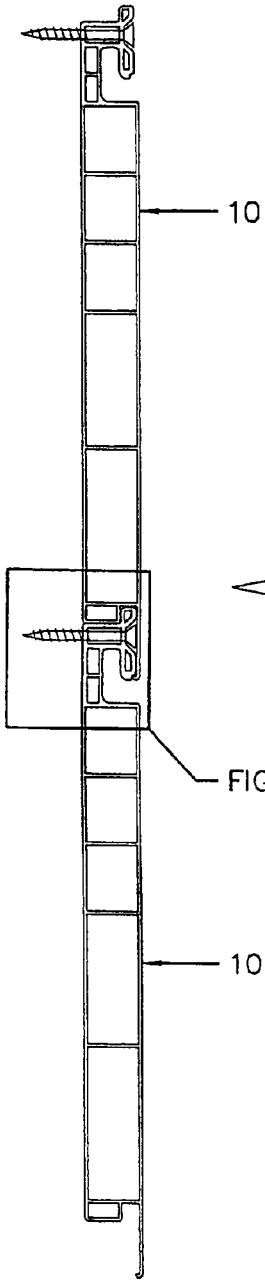
FIG. 3 is an end view of two of the panels of FIG. 1 showing interlocked panels and fastening means.
Figure 4:
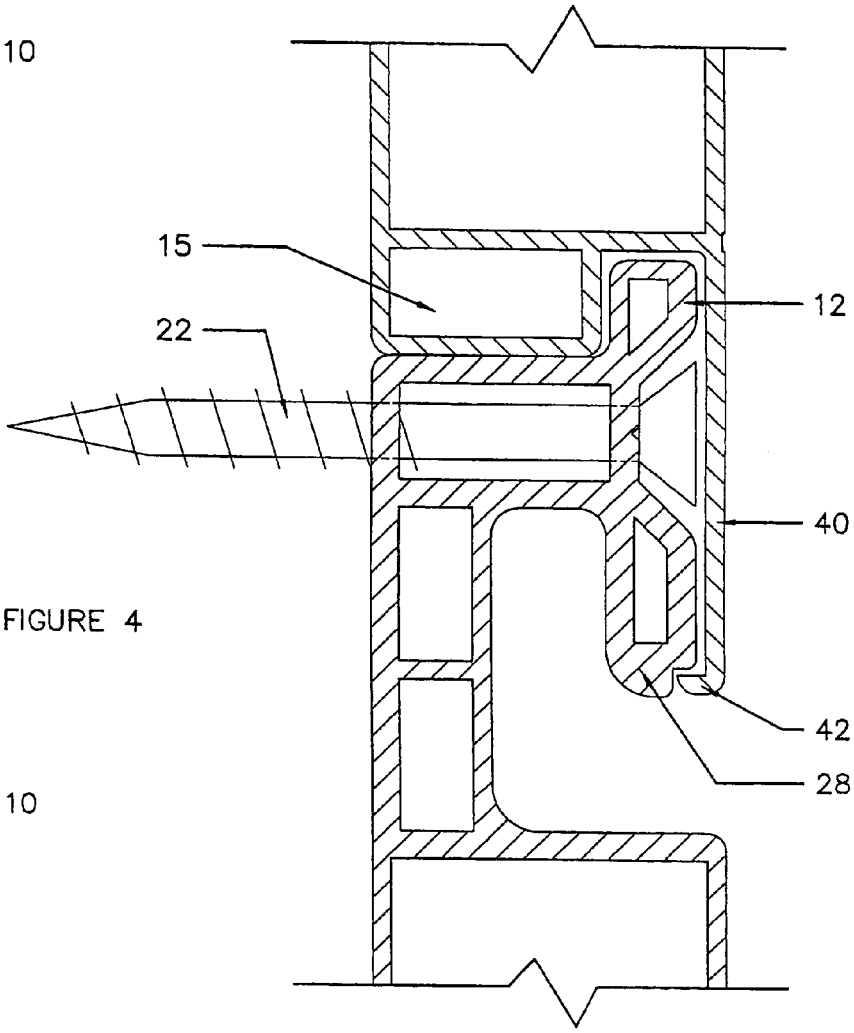
FIG. 4 is an enlarged end view of the interlocking panels and the concealed fastening means.
Figure 5:
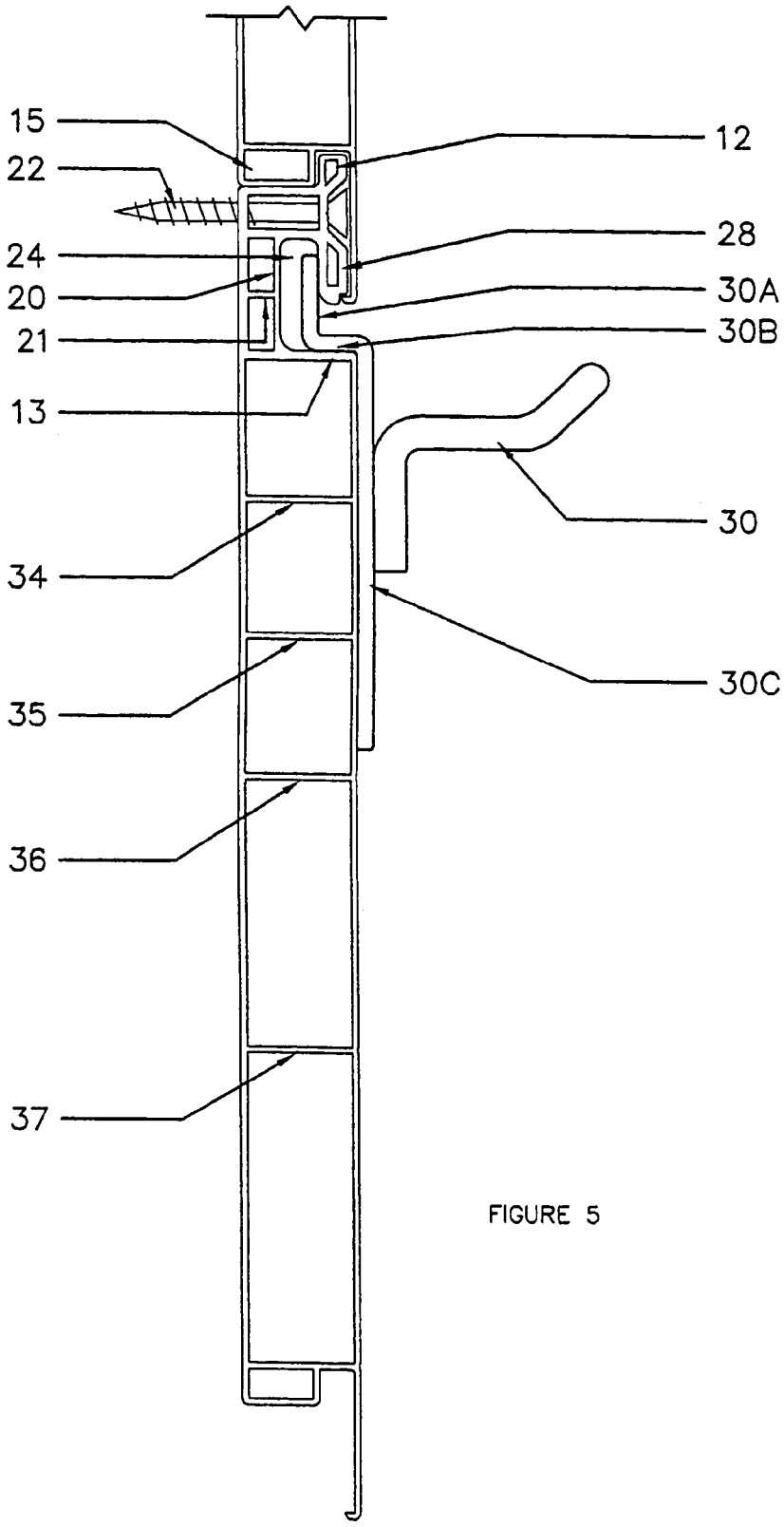
FIG. 5 is an end view of the panels including a hook.

The organizer panel (10) is an extruded profile that is manufactured in Polyvinyl Chloride but can also be extruded in other plastic materials as well as aluminum and fiberglass. The organizer panel (10) mounts to vertical walls using common fasteners (22). Industry standard accessories (30) for slotted wall panels fit into an undercut slot (24). The accessories (30) carry and transfer loads from items, such as shelves, into the organizer panel (10). The loads from the accessories transmit various forces through various parts of the organizer panel (10). The upper area (30A) of a loaded accessory (30) pushes horizontally against a rectangular hollow leg profile (28) in the organizer panel (10). This pushing force creates tension in the leg profile (28). To counter the tension, the fasteners (22) used to mount the organizer panel (10) are driven through a rectangular hollow channel (18) just above the leg profile (28) that is in tension. The fasteners head applies equal amounts of pressure to the lower leg profile (28) and an upper hollow tongue profile (12). The loaded accessory also exerts pressure downward (30B) onto a horizontal wall member (13) causing the member (13) to be in compression. To counteract the compressive force, the horizontal wall (13) member is connected to a vertical wall (20) that extends up to the bottom horizontal wall of the rectangular hollow channel profile (18). To increase the holding strength of the vertical wall (20), a horizontal wall (21) connects the vertical wall (20) to the parallel back wall (19) of the organizer panel (10). Fasteners (22) are generally spaced at 16" horizontal intervals and must be driven into structural wall supports (16) (ie. Wooden studs, concrete block etc.) The holding power of the fasteners (22) is weakest at the midpoint of the horizontal distance between two fasteners (22). As a result, the horizontal box structure (15) from the base of an adjacent organizer panel (10) that has been interlocked provides adequate resistance to counter inward forces from the upper hollow tongue profile (12).

The lower area (30C) of a loaded accessory (30) pushes inward causing the upper face of the organizer panel (10) to be in compression. Horizontal cross members (34, 35, 36) in the organizer panel (10) resist the compressive forces. The compressive forces are smaller in the lower area of the organizer panel (10). As a result, to reduce weight and costs, one horizontal cross member (37) is sufficient in this region.

The organizer panel (10) interconnects with each other via a hollow tongue profile (12) and a AU@ shaped groove (14). The horizontal box structure (15) and the hollow tongue profile (12) prevent the upper organizer panel from falling forward before it has been fastened to a wall (16). A vertical cover wall (40) that extends from the bottom of an organizer panel (10) conceals the heads of the fasteners (22) in the channel (23) of an adjacent organizer panel (10). The small curved end (42) of the vertical cover (40) snaps into a small recess (29) found on the lower hollow leg profile (28). A V notch (17) runs horizontally along the mid point of the face of the fastener channel (23) to provide the user with a visible fastener center locator.

Figure 6:
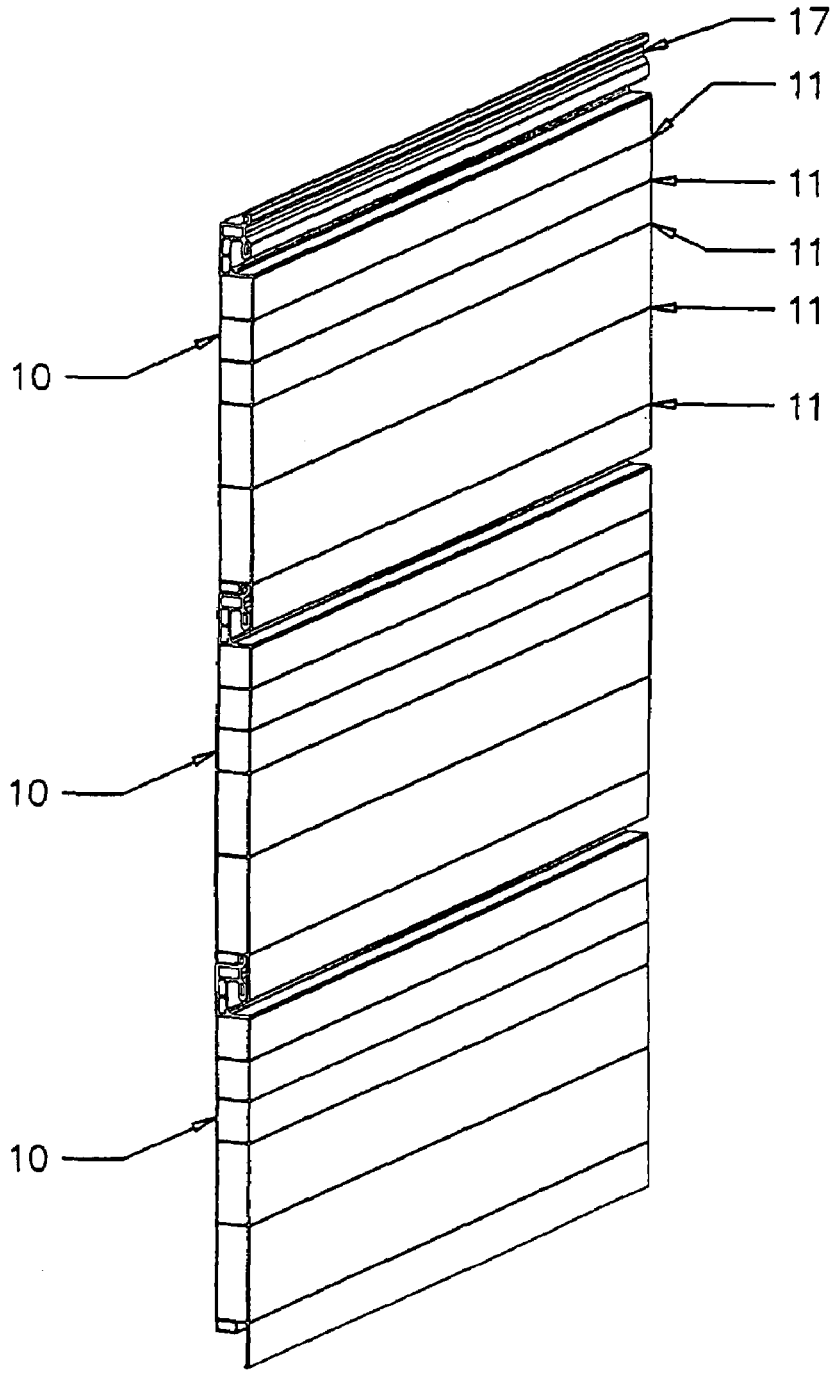
FIG. 6 is a perspective view of three panels.

Horizontal "U" shaped recesses (11) detract from the look of sink marks caused by horizontal cross members (34, 35, 35, 37) and upper horizontal support wall of "U" shaped groove (14) shown in FIG. 6.

Figure 7B:
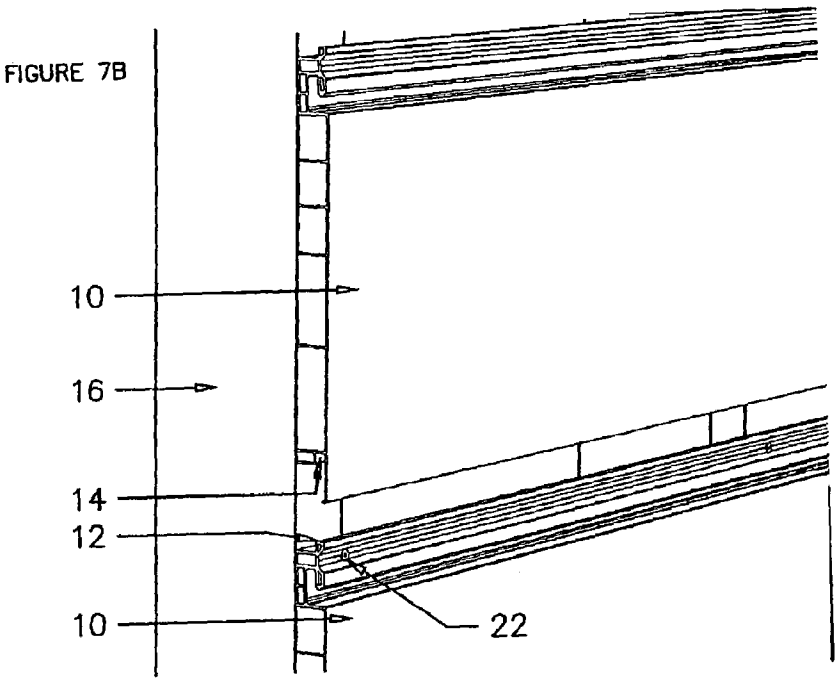
FIGS. 7B, 7C and 7D show mounting the panel on the wall.
Figure 7A:
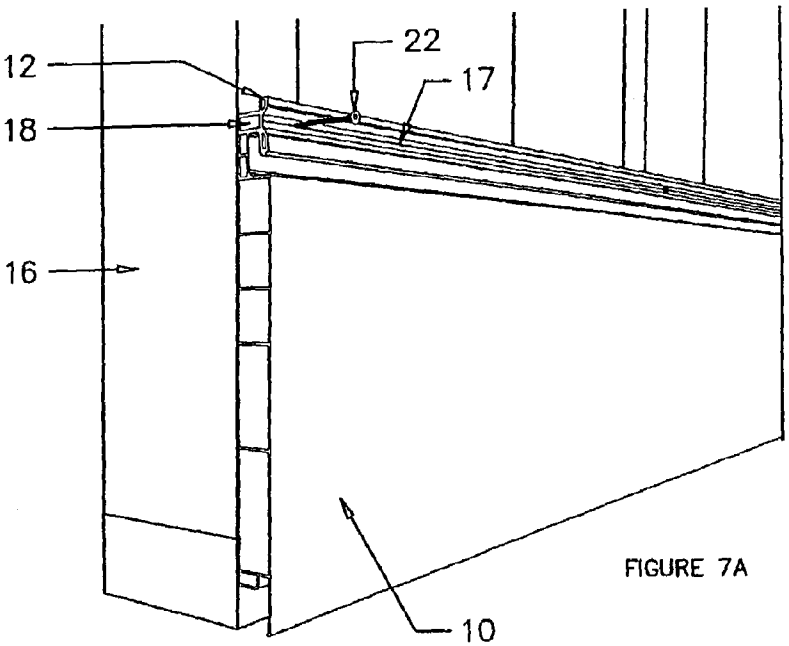
FIG. 7A is a perspective view of a panel positioned on a wall and a fastener being inserted.
Figure 7D:
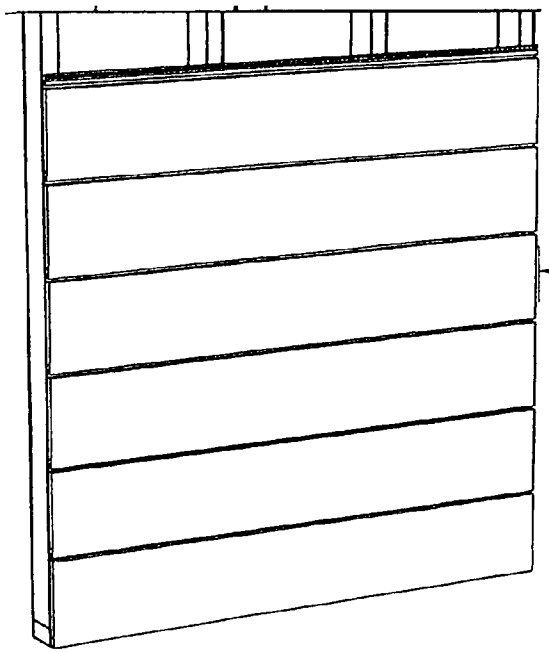
Figure 7C:
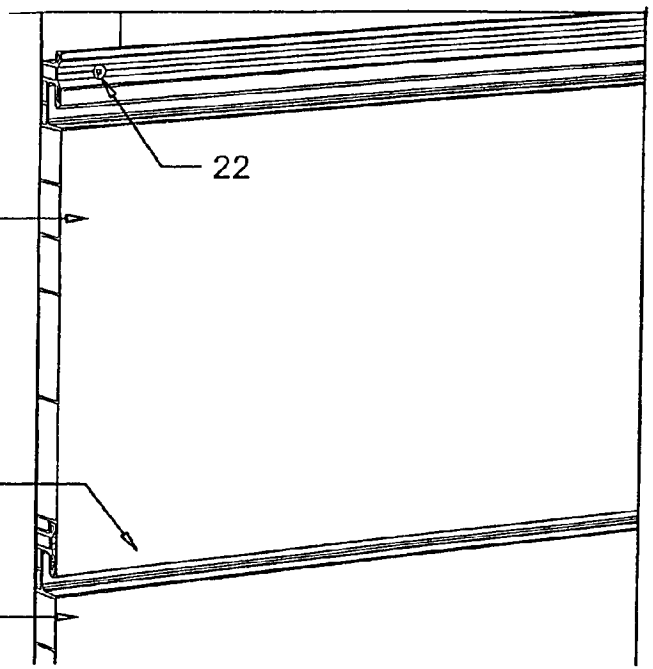

FIG. 7A, 7B, and 7C, shows the method of installation for organizer panels (10) in a perspective view. Installation of organizer panels (10) begins at the bottom and works upwards. The first organizer panel (10) is secured to a wall support (16) with one fastener (22) driven through screw channel (18) at one end of organizer panel (10). Organizer panel (10) is then leveled and more fasteners (22) are driven through screw channel (18) and into wall support (16). The next organizer panel (10) containing a groove (14) is pushed onto the tongue (12) of the previously secured organizer panel (10) and the curved end (42) of the cover leg (40) snaps into the recess (29) of the previously secured organizer panel's (10) lower hollow leg profile (28) using light pressure. Fasteners (22) are then driven though screw channel (18) into wall supports (16). As shown in FIG. 7D, installation continues in the same manner for remaining number of organizer panels (10). Organizer panels (10) can be installed side by side where a given organizer panel (10) is shorter than a wall on which the panel is being installed.

Although the primary use of the panel system (10) is for residential organization, panels can also be used in commercial applications. Commercial applications include display or merchandising panels for retail stores wherein panels are fastened to the walls, store merchandising fixtures wherein panels are fixed to a variety of vertical uprights, and trade show exhibit panels wherein panels are fixed to a variety of vertical uprights.

I claim:

1. A panel for a slat wall constructed and arranged to be interconnected in a plurality thereof and to be secured to a wall, each panel comprising:

(i) a panel body having a wall contacting inner surface, an outer surface, an upper edge and a lower edge, the edges being substantially horizontal in an installed position of the panel;

(ii) a vertical link portion connected to, and substantially horizontally coextensive with, a rear portion of the upper edge, and having a wall contacting inner surface substantially coplanar with the wall contacting inner surface of the body;

(iii) a fastener receiving member connected to and substantially horizontally coextensive with the vertical link portion, and having an upwardly extending tongue and a downwardly extending leg, each of the tongue and the leg having an outer surface, the outer surfaces being substantially vertically coplanar and together defining a substantially horizontal first groove therebetween;

(iv) the lower edge having a downwardly extending rear protrusion and a cover extending substantially coplanar with the outer surface of the panel body and having a free end having an inward projection, the cover and the rear protrusion together defining a second groove wherein in the installed position of a plurality of panels (a) the second grooves receive the tongues of adjacent panels;

(b) the panels are securable to the wall by a plurality of fastening means through the first grooves;

(c) the covers extend over the first grooves of adjacent panels; and (d) the inward projections of the covers engage with the outer surfaces of the legs of adjacent panels.

2. The panel according to claim 1, wherein the outer surface of the leg is provided with a notch, and in the installed position of a plurality of panels, the inward projections of the cover clip into notches on the legs of adjacent panels.

3. The panel according to claim 1, wherein the lower portion of the leg is constructed and arranged to cooperate with the vertical link of an adjacent panel to define an accessory mounting slot.

4. The panel according to claim 1, wherein in the installed position of a plurality of panels, the rear protrusions of the lower edges securingly engage with the tongues of adjacent panels.

5. The panel according to claim 1, wherein the panel body is substantially hollow.

6. The panel according to claim 5, wherein the panel body comprises at least one cross member extending between the wall contacting inner surface and the outer surface.

7. The panel according to claim 6, wherein substantially horizontal U-shaped recesses are provided to the outer surface of the body corresponding with a location of each cross-member.

8. The panel according to claim 1, wherein the first groove is further provided with a V-shaped notch, and in the installed position of a plurality of panels the fastening means are secured through the V-shaped notches.

9. The panel according to claim 1, wherein the cover is integrally formed with the outer surface of the panel body.

10. The panel according to claim 1, wherein the vertical link portion is integrally formed with the inner surface of the panel body.

11. The panel according to claim 1, wherein the panel is manufactured from a member of the group consisting of plastic, aluminium and fibreglass.

12. The panel according to claim 1, wherein the panel is manufactured from polyvinyl chloride.

* * * * *